United States Patent [19]

Morley, Jr.

[11] Patent Number: 4,673,185

[45] Date of Patent: Jun. 16, 1987

[54] HEXAGON TILE GAME

[76] Inventor: Harold T. Morley, Jr., 2168 E. 37th St., Tulsa, Okla. 74105

[21] Appl. No.: 737,725

[22] Filed: May 28, 1985

[51] Int. Cl.[4] ..... A63F 9/20

[52] U.S. Cl. ..... 273/294; 273/288

[58] Field of Search ..... 273/294, 288

[56] References Cited

U.S. PATENT DOCUMENTS

| | | | |
|---|---|---|---|
| 139,928 | 6/1873 | Stevens | 273/294 |
| 1,362,318 | 12/1920 | Hydes | 273/294 |
| 3,638,947 | 2/1972 | Hardesty | 273/294 X |

FOREIGN PATENT DOCUMENTS

| | | | |
|---|---|---|---|
| 2378537 | 9/1978 | France | 273/294 |
| 240612 | 10/1925 | United Kingdom | 273/294 |

OTHER PUBLICATIONS

"New Mathematical Pastimes" by P. A. MacMahon, publ. by Cambridge University Press, 1921, pp. 47–49.

*Primary Examiner*—Anton O. Oechsle

*Attorney, Agent, or Firm*—Head, Johnson & Stevenson

[57] ABSTRACT

A game apparatus is comprised of a plurality of six sided, hexagonal, tiles each tile having one planar side which is divided by indicia into six separate triangular shaped spaces, with each space being one of two differentiating colors in accordance with the mathematical possibilites of combinations or arrangement of such colors for all of the tiles where no two tiles are alike. A division line divides the tile into two sections of three triangular spaces. In one of the sections a third indicia or dot is placed at the center triangular space on a certain number of tiles, as a further identifying mark in the playing of the game. Two additional hexagonal pieces are of solid color one of one color the other of the other color. One of such additional pieces includes the third indicia in every other space and includes no division line. The game is played by matching three or more spaces, color for color or third indicia, i.e., dot for dot with attempts by the players to shift the lesser of the mathematical opportunites of play to other player or players.

19 Claims, 7 Drawing Figures

HEXAGON TILE GAME

BACKGROUND OF THE INVENTION

The prior art of games utilizing tiles with a variety indicia thereon are represented by the following U.S. patents:

U.S. Pat. No. 1,121,989: Dryer
U.S. Pat. No. 1,362,318: Hydes
U.S. Pat. No. 1,558,165: Haswell
U.S. Pat. No. 1,666,448: Hardenstein
U.S. Pat. No. 2,072,605: Palmer
U.S. Pat. No. 3,547,444: Williams et al
U.S. Pat. No. 4,305,585: Flynn

SUMMARY OF THE INVENTION

This invention relates to a game and more particularly to a game that is played on any flat surface.

An object of the present invention is to provide a game utilizing hexagonal i.e. six-sided tiles in which each of the tiles have indicia thereon on one planar side. The indicia comprises six separated spaces at the outside edge. Each of the spaces on sixty-two of the tiles being one of two distinct colors. A visible "division" line is also across the center of said sixty-two tiles dividing the tile into a upper section of three spaces and lower section of the remaining three spaces. The three spaces of each tile section are constructed to meet every mathmatical possiblity of said two color combination. A third contrasting indicia, e.g., a dot, is positioned adjacent the outer edge of the center space of one of said sections of each of fifty-six tiles. Six of the sixty-two tiles do not have the third contrasting indicia but their arrangement of color spaces in each section is the same. A sixty-third tile is all one color in both sections and a sixty-fourth tile is all of the other color in both sections and do not require a division line. One of said sixty-third and sixty-fourth tiles having a said third color contrasting indicia in every other one of said spaces. This latter tile is designated the "core" piece.

A more particular object of the invention is to provide a tile as above described wherein the spaces are triangular and the first and second colors are black and white, while the third contrasting indicia color is gold or black on white and white on black.

The game is played by one or more persons by arranging each game tile so as to be compatible with an already played tile or tiles as set forth herein. Thus, each game is without repetition and presents different mathematical combinations for play that arouses the skill of multiple players in shifting lower odds of play to the opposing player or players.

Another object of the invention is to provide an inexpensive and easily manufactured game tiles that will arouse the interest of the average person and yet will sufficiently challenge the skill and ingenuity of expert and seasoned players.

Other objects and features of the invention will become apparent to those skilled in the art from the following specification and accompanying drawings.

DETAILED DESCRIPTION OF THE PREFERRED EMBODIMENT

Before explaining the present invention, in detail, it is to be understood that the invention is not limited in its application to the details of construction and arrangement of parts illustrated in the accompanied drawings, since the invention is capable of other embodiments and being practiced or carried out in a variety of ways. Also, it is to be understood that the phraseology or terminology employed herein is for the purpose for description and not of limitation.

Figure 1:
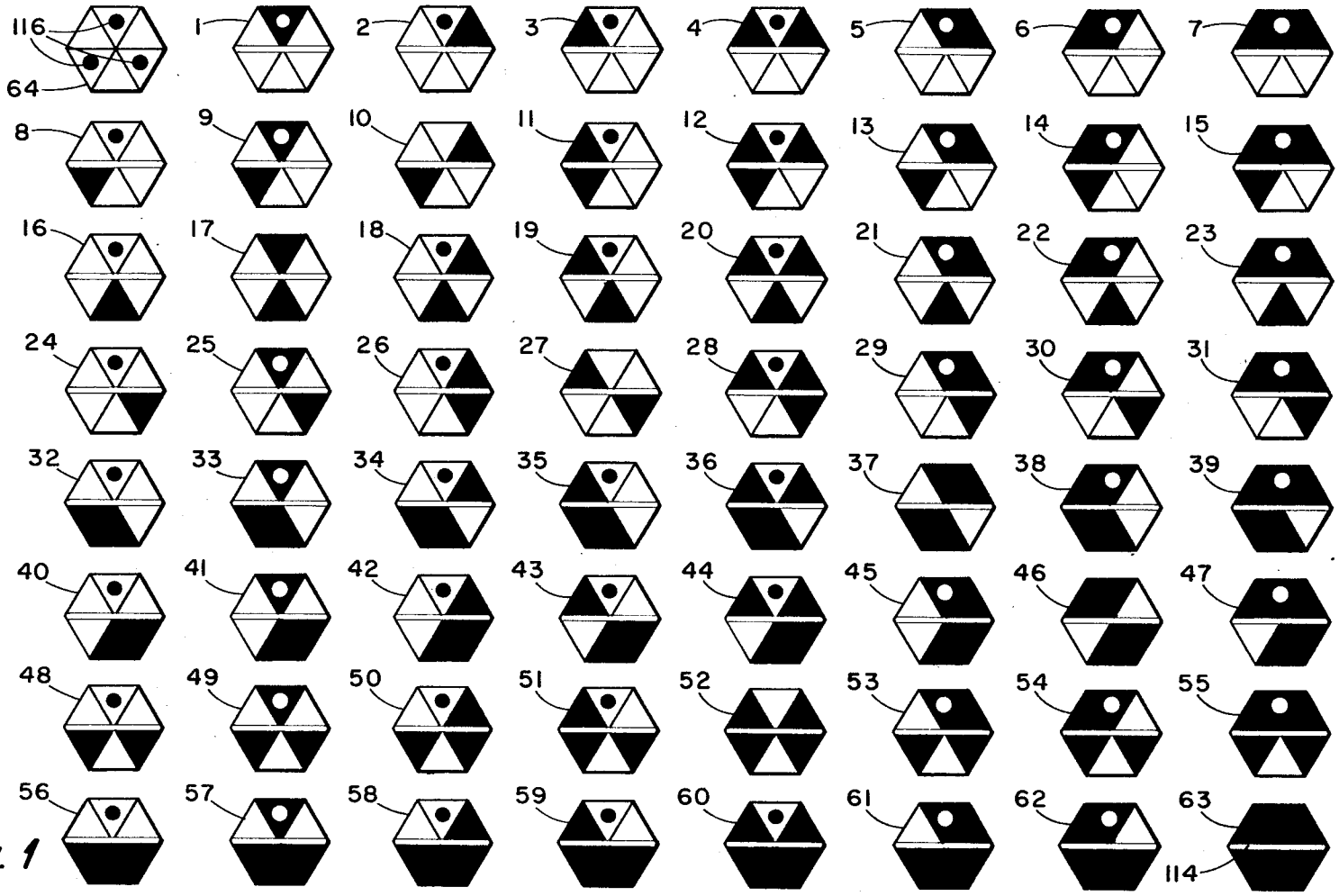
FIG. 1 is a top view of the tiles of this invention.

Referring now to FIG. 1 the top planar surface of each of the sixty-four tiles used in the game is represented. For purposes of this description, the tiles are numbered 1 through 64. Each tile is different as to a combination of colors and indicia as will be more particularly identified herein.

Each planar surface of the tile is divided into six separated triangular spaces from each edge of the hexagonal tile. Each of the triangular spaces on tiles one through sixty-two being the mathematical combination of one of two colors with no two tiles alike. A visible division line of any distinctive color or combination of colors extends across the center of the tile dividing it into an upper section of three triangular spaces and a lower section of the remaining three triangular spaces. Each of the three triangular spaces of each section of each tile comprising every possible combination of the two colors used. In this instance, black and white is used.

Figure 2:
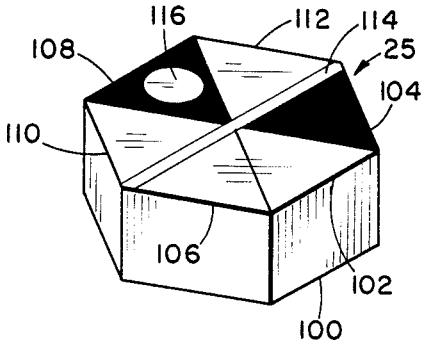
FIG. 2 is perspective view of an individual tile.

Referring now to FIG. 2 a representative tile 25 from FIG. 1 is shown in perspective and includes a planar base surface 100 with hexagonal sides 102, 104, 106, 108, 110 and 112. The tile is constructed of thickness so as to be convenient to handle and store and also to rest in a vertical position upon the playing surface. A division line indicia 114 divides the tile into a lower section of three triangles formed by sides 102, 104 and 106 while the upper section is formed of triangular sections 108, 110 and 112. In this instance, the lower section, in a clockwise direction comprises triangular sections of black-white-white, while the upper section is white-black-white. The division line 114 would be of contrasting color for e.g., gold. In the upper section within the center space 108 formed by side 108 will be found a third indicia 116, typically a dot of a contrasting color to space 108. This dot does not appear in six of the tiles i.e. numbers 10, 17, 27, 37, 46 and 52 nor does it appear in the all black tile 63 which does not necessarily include a division line 114 although it could. Tile number 64 is of the contrasting color i.e. all white, and includes indicia 116 in every other space and does not necessarily include a division line since this is the starter "core" piece of the game.

Figure 5:
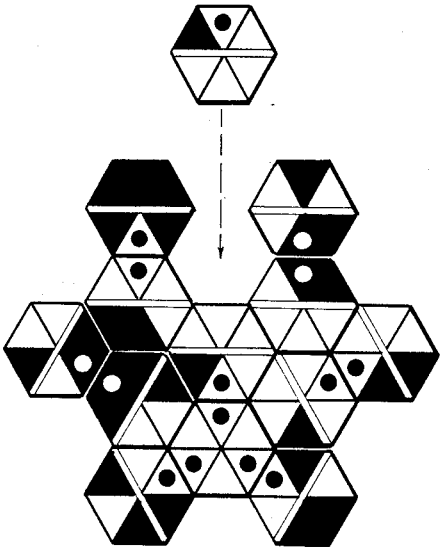
FIGS. 3, 4 and 5 are representative of the play of the game of this invention.
Figure 4:
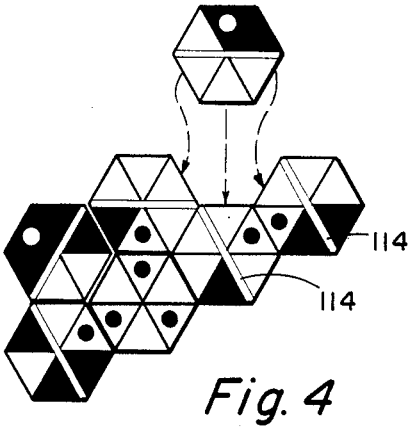
Figure 3:
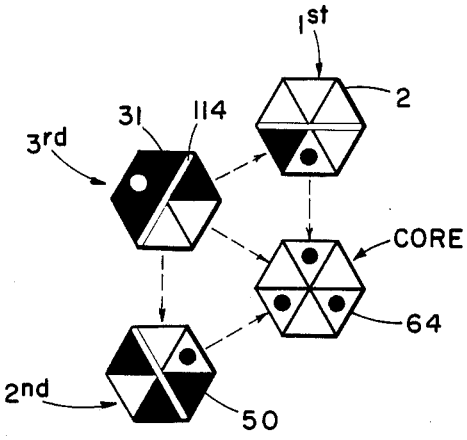
Figure 6:
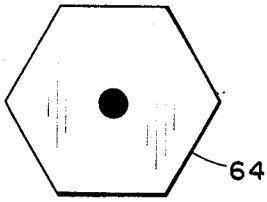
FIG. 6 is a bottom view of the core tile used in the invention.

Play of the game is expressed in FIGS. 3, 4 and 5. Before play begans, all of the tiles are turned face down and mixed. The "core" tile number 64 as shown in FIG. 6 has some form of indicia on the back to indicate the beginning tile. Otherwise it would be difficult to locate when all the tiles are face down. The core tile 64 is placed on the surface between the players. Each player draws eight tiles, standing them on end out of the view of opponents while the remaining tiles become the drawing pile. The sequence of play, in the event of more than two players is in an agreed upon direction, with the first player being decided and subsequent players following in sequence. This is not a limiting sequence however, as other forms of sequential starting and playing can be decided upon.

There are two basic plays (1) match dot and color space or (2) match at least three adjacent non-dotted color spaces of one section, i.e. on one side of the division line 114.

As shown in FIG. 3 the first player must match a dot on a white triangle to the core tile from the pieces held. If he is unable to do so he must draw from the drawing pile until a match is found. In this case tile 2 would be placed, for example, by the person at the position shown in FIG. 3. Once a play is made the play shifts to next player who for example can play tile 50 in the position as shown. Play continues as for example by the placement of tile 31 which in this instance must have all of the spaces on one side of the division line 114 matching with the appropriate spaces on tile numbers 2, 64 and tile number 50. This play becomes possible only after play of the 1st and 2nd tile as shown, and not before. This is shown in FIG. 4. Play continues, the requirement being that the player must match tile space-to-tile space color-to-color and dot-to-dot above the division line 114 formed in tile pieces 1 through 63 Subsequent play continues as is shown in FIGS. 4 and 5.

If a player is unable to match a tile, as said before, tiles must be picked from the drawing pile until a match can be made. If all the tiles from the drawing pile have been drawn and the player cannot make a match, he must pass his turn. Play continues until one player has used all of his tiles, or until no one can play.

Although scoring of the game can be accomplished in a variety of ways one manner to do is to count one point for each black triangle space on the tiles remaining in play, at the end of each game that is within each players hand. The game could end when a player reaches 100 points. The player with the least points wins. During the course of the game a space may develop among the tiles played such as shown in FIG. 5 presenting five sides of the hexagon tile. If the triangle spaces forming the parameter of this space can be matched by a tile held by a player, the other players are each given a penalty, e.g., 25 points.

Other interesting variations occur in playing the game as for example, remove from play all tiles with dots on black triangles and use the same rules. Also a sixty-fifth all white tile, not shown, could be included.

Figure 7:
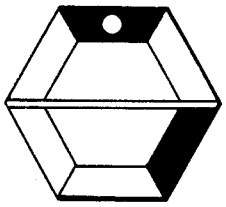
FIG. 7 is a plan view of an alternate indicia marking for the tile.

Although triangular spaces are shown herein it is understood that only the outer portion of the triangle adjacent each outside edge be colored to provide proper indicia, such as is shown in FIG. 7.

One variation of play is as a solitaire game. Beginning with core 64, the player would not draw beginning tiles but would draw and play, if he can, tiles individually from the drawing pile until the player compiled e.g., eight unplayable tiles.

The game is susceptible to computer programming and play as on a video display.

What is claimed:

1. A game apparatus comprising at least sixty-four six-sided tiles each of said tiles having a indicia thereon one planar side, said indicia comprising six separate triangle spaces with the base of each triangle space at an outside edge of the tile, each of said triangle spaces on sixty-two of said tiles being one of two colors, a visible line across the center of said sixty-two tiles dividing the tiles into an upper section of three of said triangle spaces and lower section of three of the remaining triangle spaces, the three triangle spaces of each section of each tile being representative of every possiblility of said two color combinations, a sixty-third tile being all one color in both sections, and a sixty-fourth tile being all of the other color in both sections, a contrasting color indicia positioned in the center triangle space of of said sections of at least fifty-six of said sixty-one two tiles, and one of said sixty-third and sixty-fourth tiles having said contrasting color indicia in every other one of said triangle spaces.

2. A game apparatus according to claim 1 wherein said two colors are black, white and said contrasting color indicia is gold.

3. A game apparatus according to claim 2 wherein said contrasting color indicia is black on a white triangular space and white on a black triangular space.

4. A game apparatus according to claim 2 wherein said visible line is gold.

5. A game apparatus according to claim 3 wherein said visible line is white.

6. A game apparatus according to claim 1 wherein said contrasting color indicia is a dot.

7. A game apparatus according to claim 1 including a sixty-fifth tile in which all spaces are of the same color as said one of said sixty-third and sixty-fourth tiles that contains said contrasting color indicia but without said contrasting color indicia.

8. A game apparatus comprising at least sixty-four six-sided tiles each of said tiles having a indicia thereon one planar side, said indicia comprising six separated spaces at each outside edge of the tile, each of said spaces on sixty-two of said tiles being one of two colors, a visible line across the center of said sixty-two tiles dividing the tiles into an upper section of three of said spaces and lower section of three of the remaining spaces, the three spaces of each section of each tile being representative of every possibility of said two color combinations, a contrasting color indicia positioned in the center space of one of said sections on at least fifty-six of said sixty-two tiles, a sixty-third tile being all of one color in both sections, and a sixty-fourth tile being all of the other color in both sections, and one of said sixty-third and sixty-fourth tiles having said contrasting color indicia in every other one of said triangle spaces.

9. A game apparatus according to claim 8 wherein said two colors are black, white and said contrasting color indicia is gold.

10. A game apparatus according to claim 9 wherein said contrasting color indicia is black on a white space and white on a black space.

11. A game apparatus according to claim 9 wherein said visible line is gold.

12. A game apparatus according to claim 10 wherein said visible line is white.

13. A game apparatus according to claim 8 wherein said contrasting color indicia is a dot.

14. A game apparatus according to claim 8 including a sixty-fifth tile in which all spaces are of the same color as said one of said sixty-third and sixty-fourth tiles that contains said contrasting color indicia but without said contrasting color indicia.

15. A hexagonal sided tile piece used in playing a game with a plurality of said tile pieces, said piece comprising one planar surface which is divided into six equal spaces coinciding with each side of said hexagon, each of said spaces being one of two possible colors, a distinct visible line across the center of said planar surface conspicuously dividing the tile into an upper section of three of said spaces, and a lower section of the three remaining of said spaces.

16. A tile piece of claim 15 including a contrasting color indicia positioned in the center space of one of said sections.

17. A hexagonal sided tile piece used in playing a game with a plurality of said tile pieces, said piece comprising one planar surface which is divided into six equal spaces coinciding with each side of said hexagon, each of said spaces being of one color, said triangular spaces having alternating contrasting color indicia between spaces having no contrasting color indicia.

18. The tile pieces of claim 17 wherein each of said spaces are white and said contrasting color indicia are black.

19. The tile pieces of claim 17 wherein each of said spaces are black and said contrasting color indicia are white.

* * * * *